US009327147B2

(12) United States Patent
Snider et al.

(10) Patent No.: US 9,327,147 B2
(45) Date of Patent: May 3, 2016

(54) ROOF ANCHOR

(75) Inventors: Philip K. Snider, Red Wing, MN (US); Matthew J. Blackford, Hastings, MN (US); J. Thomas Wolner, Red Wing, MN (US)

(73) Assignee: D B Industries, LLC, Red Wing, MN (US)

( * ) Notice: Subject to any disclaimer, the term of this patent is extended or adjusted under 35 U.S.C. 154(b) by 2686 days.

(21) Appl. No.: 11/924,104

(22) Filed: Oct. 25, 2007

(65) Prior Publication Data

US 2008/0271407 A1 Nov. 6, 2008

Related U.S. Application Data

(60) Provisional application No. 60/856,772, filed on Nov. 3, 2006.

(51) Int. Cl.

| | |
|---|---|
| ***A62B 35/04*** | (2006.01) |
| ***A62B 35/00*** | (2006.01) |
| ***E04D 13/12*** | (2006.01) |
| ***E04G 21/32*** | (2006.01) |

(52) U.S. Cl.

CPC ..... *A62B 35/0068* (2013.01); *E04D 13/12* (2013.01); *E04G 21/3261* (2013.01); *A62B 35/04* (2013.01)

(58) Field of Classification Search

CPC ..... A62B 35/0043; A62B 35/0068; A62B 35/04; E04G 21/3261

USPC ..... 182/3; 52/698; D8/356

See application file for complete search history.

(56) References Cited

U.S. PATENT DOCUMENTS

| | | | |
|---|---|---|---|
| 175,415 | A | 3/1876 | Bunker |
| 600,478 | A | 3/1898 | Collier |
| 834,924 | A | 11/1906 | Meech |
| 1,048,501 | A | 12/1912 | Dawson |
| 1,127,832 | A | 2/1915 | Voigt |
| 1,130,438 | A | 3/1915 | Schmidt |
| 1,509,781 | A | 9/1924 | Roth |
| 1,516,292 | A | 11/1924 | Holstein |
| D87,730 | S | 9/1932 | Silverman et al. |
| 2,406,270 | A | 8/1946 | Torell |

(Continued)

FOREIGN PATENT DOCUMENTS

WO WO/2006/123979 11/2006

OTHER PUBLICATIONS

Guardian Fall Protection, Ridge-It Anchors, website page and associated PDF files, 9 pages, Aug. 2004 and Feb. 2005, Kent, Washington.

(Continued)

*Primary Examiner* — Colleen M Chavchavadze
(74) *Attorney, Agent, or Firm* — IPLM Group, P.A.

(57) ABSTRACT

A roof anchor comprises a pliable member including an interconnecting portion interconnecting a first portion and a second portion. The first portion and the second portion each include a securing portion with a plurality of apertures and a connecting portion with an aperture. A first notch and a second notch are proximate the junctures of each securing portion and connecting portion. The first notch and the second notch extend inward from opposing sides and toward proximate a middle of the respective first and second portions, and an aperture is between each first notch and second notch.

15 Claims, 5 Drawing Sheets

(56) References Cited

U.S. PATENT DOCUMENTS

| | | | | | |
|---|---|---|---|---|---|
| 2,606,727 | A | | 8/1952 | De Haven | |
| 2,686,920 | A | | 8/1954 | Meeker | |
| 2,851,135 | A | | 9/1958 | Woodruff | |
| 3,165,168 | A | | 1/1965 | Rose | |
| 3,481,635 | A | * | 12/1969 | Tracy | 403/3 |
| 4,121,688 | A | | 10/1978 | Lirakis | |
| 4,138,806 | A | | 2/1979 | Miller | |
| 4,175,304 | A | | 11/1979 | Bentley | |
| D254,534 | S | | 3/1980 | Glynn et al. | |
| 4,249,713 | A | | 2/1981 | Glynn et al. | |
| 4,298,091 | A | | 11/1981 | Anderson | |
| 4,365,391 | A | | 12/1982 | Chapalain | |
| 4,396,091 | A | | 8/1983 | Anderson | |
| 4,478,311 | A | | 10/1984 | Anderson | |
| 4,632,105 | A | | 12/1986 | Barlow | |
| D298,867 | S | | 12/1988 | Herron | |
| 5,010,850 | A | | 4/1991 | Sailer | |
| 5,014,470 | A | | 5/1991 | Lane et al. | |
| 5,146,876 | A | | 9/1992 | McPhail | |
| 5,174,410 | A | | 12/1992 | Casebolt | |
| 5,248,021 | A | | 9/1993 | Nichols | |
| 5,261,728 | A | | 11/1993 | Carmichael | |
| 5,279,386 | A | | 1/1994 | Cearley | |
| 5,319,896 | A | | 6/1994 | Winger | |
| 5,361,558 | A | * | 11/1994 | Thornton et al. | 52/698 |
| 5,361,726 | A | | 11/1994 | Harris et al. | |
| 5,425,485 | A | | 6/1995 | Carlo | |
| 5,438,734 | A | | 8/1995 | Anderson | |
| D367,949 | S | | 3/1996 | Vallance | |
| 5,522,184 | A | | 6/1996 | Oviedo-Reyes | |
| 5,553,685 | A | * | 9/1996 | Cook | 182/45 |
| D375,924 | S | | 11/1996 | Kramer | |
| 5,579,794 | A | | 12/1996 | Sporta | |
| 5,623,788 | A | | 4/1997 | Bimberg et al. | |
| 5,664,639 | A | | 9/1997 | Worth | |
| D384,486 | S | | 10/1997 | Herrli | |
| 5,678,379 | A | | 10/1997 | Quattrociocchi | |
| 5,730,407 | A | * | 3/1998 | Ostrobrod | 248/237 |
| 5,785,146 | A | | 7/1998 | Palmer | |
| 5,819,483 | A | | 10/1998 | Wells | |
| 5,896,719 | A | * | 4/1999 | Thornton | 52/698 |
| 5,960,480 | A | | 10/1999 | Neustater et al. | |
| 5,967,095 | A | | 10/1999 | Greves | |
| 5,983,760 | A | | 11/1999 | Clarke | |
| 6,038,745 | A | | 3/2000 | Rapp | |
| 6,085,500 | A | | 7/2000 | Keppick | |
| 6,098,746 | A | * | 8/2000 | Castaneda | 182/45 |
| 6,138,425 | A | | 10/2000 | Wendt | |
| D434,544 | S | | 12/2000 | Goldman | |
| 6,176,056 | B1 | | 1/2001 | MacKarvich | |
| 6,199,246 | B1 | | 3/2001 | Cibin et al. | |
| 6,273,113 | B1 | | 8/2001 | Streyckmans | |
| D449,136 | S | | 10/2001 | Vallance | |
| 6,343,449 | B1 | | 2/2002 | MacKarvich | |
| D454,670 | S | | 3/2002 | Weller | |
| D457,688 | S | | 5/2002 | Cordero | |
| 6,412,540 | B2 | | 7/2002 | Hendee | |
| 6,418,685 | B1 | | 7/2002 | Oliver et al. | |
| 6,581,726 | B1 | | 6/2003 | Petzl et al. | |
| 6,606,768 | B2 | | 8/2003 | Henry et al. | |
| 6,609,340 | B2 | | 8/2003 | Moore et al. | |
| 6,637,077 | B2 | | 10/2003 | Doty | |
| 6,648,381 | B2 | | 11/2003 | Holton et al. | |
| 6,668,509 | B1 | | 12/2003 | Krebs | |
| 6,851,393 | B2 | | 2/2005 | Bremm | |
| 6,945,356 | B2 | | 9/2005 | Luke et al. | |
| D527,166 | S | | 8/2006 | Hoeksema | |
| 7,103,943 | B2 | | 9/2006 | Lambert | |
| D535,058 | S | | 1/2007 | Boutin | |
| 7,380,373 | B2 | * | 6/2008 | Crookston | 52/127.5 |
| 7,832,153 | B2 | * | 11/2010 | Crookston | 52/127.5 |
| 2002/0023595 | A1 | | 2/2002 | Kaufman | |
| 2002/0079164 | A1 | | 6/2002 | Choate | |
| 2003/0093884 | A1 | | 5/2003 | Doty | |
| 2004/0069565 | A1 | | 4/2004 | Luke et al. | |
| 2005/0139419 | A1 | | 6/2005 | Green | |
| 2005/0166468 | A1 | | 8/2005 | Pierce | |
| 2005/0230184 | A1 | | 10/2005 | Ansaldo | |
| 2005/0257446 | A1 | | 11/2005 | Wolner et al. | |
| 2006/0048998 | A1 | | 3/2006 | Wolner et al. | |
| 2006/0070798 | A1 | | 4/2006 | DiCristina et al. | |
| 2006/0236601 | A1 | | 10/2006 | Barber | |
| 2006/0260260 | A1 | | 11/2006 | Blackford | |
| 2006/0272890 | A1 | | 12/2006 | Harmon et al. | |
| 2007/0012262 | A1 | | 1/2007 | Cole | |
| 2007/0022672 | A1 | | 2/2007 | Bachynski | |

OTHER PUBLICATIONS

Guardian Fall Protection, Temper Anchor, website page and associated PDF file, 3 pages, date unknown, Kent, Washington.

Guardian Fall Protection, Snappy Anchors, website page and associated PDF file, 3 pages, date unknown, Kent, Washington.

Bacou-Dalloz, Miller® Permanent Roof Anchors, product brochure, 2 pages, date unknown.

D B Industries, Inc., User Instruction Manual for 2103676 Roof Anchors, 12 pages, 2003, Red Wing, Minnesota.

D B Industries, Inc., User Instruction Manual for 2103673 Roof Anchor and 76002001/7600202 Sayfline™ Horizontal Lifeline System, 12 pages, 2003, Red Wing, Minnesota.

D B Industries, Inc., User Instruction Manual for AJ730A Roof Anchors, 12 pages, offered for sale Jun. 3, 2003, Red Wing, Minnesota.

* cited by examiner

FIG. 3
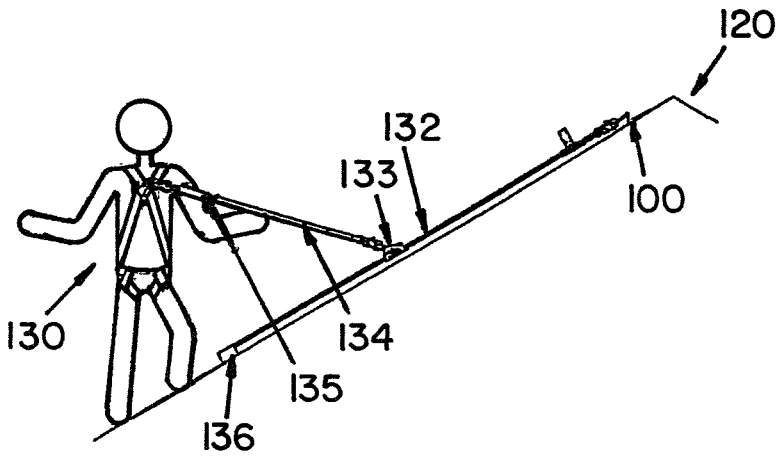
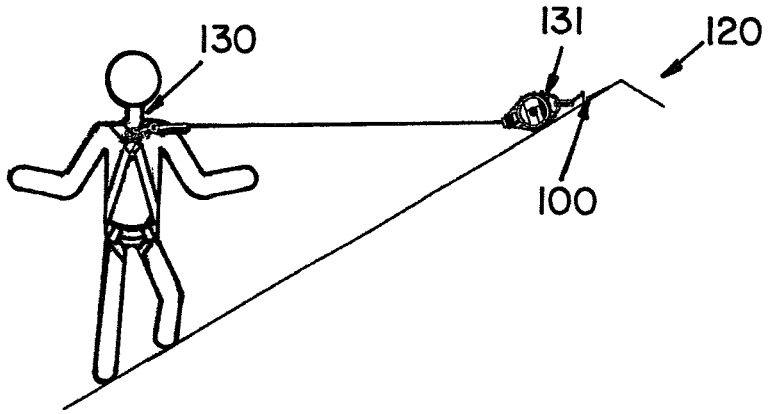
FIG. 2

ROOF ANCHOR

This application claims the benefit of U.S. Provisional Patent Application Ser. No. 60/856,772, filed Nov. 3, 2006.

FIELD OF THE INVENTION

The present invention relates to an anchor for a roof for use with a fall protection safety system.

BACKGROUND OF THE INVENTION

Anchor devices, such as roof anchors, are commonly used as anchorage points for fall protection safety systems while performing roof construction or repair. Fall protection safety systems include many types of fall arrest and restraint equipment. For fall arrest purposes, the user dons a full body safety harness and connects to the roof anchor with a suitable type of connecting system such as an energy absorbing lanyard or a self-retracting lifeline when there is a risk of a free fall occurring before the fall is arrested. For restraint purposes, the user dons a full body safety harness and connects to the roof anchor with a lanyard or other suitable restraint device to restrain or tether the user from reaching a hazard, such as the leading edge of the roof, when there is no risk of a vertical free fall. Roof anchors may be temporary or permanent.

Prior art roof anchors secured to a roof structure such as a truss tend to peel away from the roof proximate the fasteners when subjected to a fall at an angle other than straight down relative to the roof anchor. Therefore, it is desired to provide a roof anchor that does not peel away from the roof when subjected to the forces of a fall.

SUMMARY OF THE INVENTION

In one aspect of the present invention, a roof anchor comprises a pliable member including an interconnecting portion interconnecting a first portion and a second portion. The first portion includes a first securing portion with a first plurality of apertures and a first connecting portion with a first aperture. A first notch and a second notch are proximate a first juncture of the first securing portion and the first connecting portion. The first notch and the second notch extend inward from opposing sides of the first portion toward proximate a middle of the first portion. A second aperture is between the first notch and the second notch. The second portion includes a second securing portion with a second plurality of apertures and a second connecting portion with a third aperture. A third notch and a fourth notch are proximate a second juncture of the second securing portion and the second connecting portion. The third notch and the fourth notch extend inward from opposing sides of the second portion toward proximate a middle of the second portion. A fourth aperture is between the third notch and the fourth notch.

Another aspect of the present invention comprises a method of securing a roof anchor to a mounting surface. The roof anchor includes a pliable member including an interconnecting portion interconnecting a first portion and a second portion. The first portion includes a first securing portion with a first plurality of apertures and a first connecting portion with a first aperture. A first notch and a second notch are proximate a first juncture of the first securing portion and the first connecting portion. The first notch and the second notch extend inward from opposing sides of the first portion toward proximate a middle of the first portion. A second aperture is between the first notch and the second notch. The second portion includes a second securing portion with a second plurality of apertures and a second connecting portion with a third aperture. A third notch and a fourth notch are proximate a second juncture of the second securing portion and the second connecting portion. The third notch and the fourth notch extend inward from opposing sides of the second portion toward proximate a middle of the second portion. A fourth aperture is between the third notch and the fourth notch. A fastener is inserted through each of the first and second plurality of apertures and the second and fourth apertures, and the fasteners are secured to the mounting surface.

BRIEF DESCRIPTION OF THE DRAWINGS

FIG. 2 is a side view of a roof onto which the roof anchor shown in FIG. 1 is operatively connected and a user operatively connected to the roof anchor with a self-retracting lifeline;

FIG. 3 is a side view of a roof onto which the roof anchor shown in FIG. 1 is operatively connected and a user operatively connected to the roof anchor with a lanyard;

DETAILED DESCRIPTION OF A PREFERRED EMBODIMENT

Figure 1:
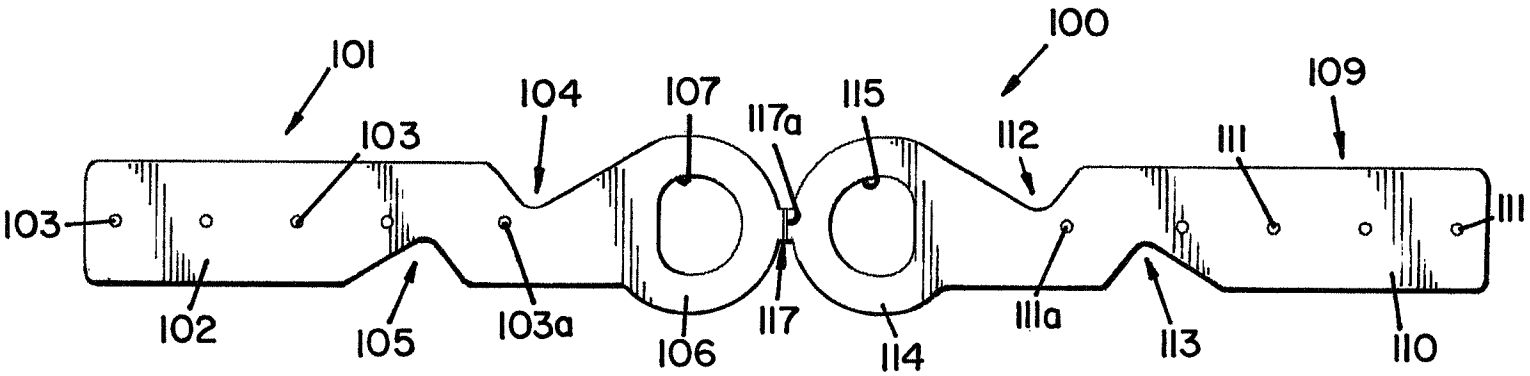
FIG. 1 is a top view of a roof anchor constructed according to the principles of the present invention.

A preferred embodiment roof anchor constructed according to the principles of the present invention is designated by the numeral 100 in the drawings. The roof anchor 100 provides an anchorage point for various types of fall protection safety systems such as fall arrest and restraint equipment.

Figure 7:
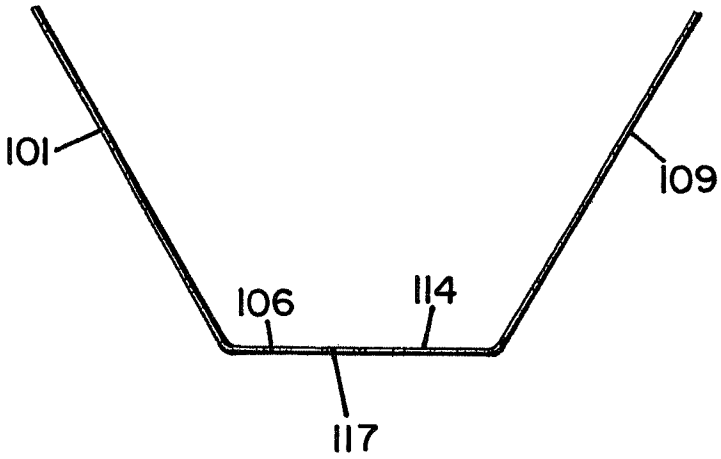
FIG. 7 is a side view of a roof anchor in a formed configuration.

As shown in FIG. 1, the roof anchor 100 is preferably one integral piece stamped from a sheet of relatively pliable but strong material such as metal, preferably 14 gauge carbon steel, which is preferably then formed and plated with zinc. Although the roof anchor 100 is preferably pre-formed, as shown in FIG. 7, it is recognized that it could also be in a flattened configuration, as shown in FIG. 1, and then formed prior to use. The roof anchor 100 includes a first portion 101, a second portion 109, and an interconnecting portion 117 interconnecting the first portion 101 and the second portion 109. The first portion 101 has a securing portion 102, through which a plurality of longitudinally spaced apertures 103 extends, and a connecting portion 106. Preferably, there are four apertures 103. Proximate the juncture of the securing portion 102 and the connecting portion 106 are a first notch 104 and a second notch 105. The first notch 104 and the second notch 105 extend inward from opposing sides of the first portion 101 toward proximate the middle of the first portion 101 in a staggered arrangement with the first notch 104 being more proximate the connecting portion 106 and the second notch 105 being more proximate the securing portion 102. Between the notches 104 and 105 is an aperture 103*a*. The connecting portion 106 includes an aperture 107.

The second portion 109 has a securing portion 110, through which a plurality of longitudinally spaced apertures 111 extends, and a connecting portion 114. Preferably, there are four apertures 111. Proximate the juncture of the securing portion 110 and the connecting portion 114 are a first notch 112 and a second notch 113. The first notch 112 and the second notch 113 extend inward from opposing sides of the second portion 109 toward proximate the middle of the second portion 109 in a staggered arrangement with the first notch 112 being more proximate the connecting portion 114 and the second notch 113 being more proximate the securing portion 110. Between the notches 112 and 113 is an aperture 111*a*. The connecting portion 114 includes an aperture 115. The interconnecting portion 117 interconnects the connecting portions 106 and 114. Preferably, the second portion 109 is a mirror image of the first portion 101.

The interconnecting portion 117 may be folded, preferably approximately in half, so that the apertures 107 and 115 are in alignment with one another forming an opening through which a suitable connector such as a carabiner or a snap hook may be inserted for interconnecting a lifeline or a lanyard and the connecting portions 106 and 114. The opening provides an anchor aperture. To assist in folding the interconnecting portion 117, the interconnecting portion 117 may include a score line 117*a* along which the interconnecting portion 117 should be folded. Because the score line 117*a* creates a thinner portion relative to the rest of the interconnecting portion 117, the thinner portion is easier to fold along the score line 117*a*.

If the roof anchor 100 is in a flattened configuration as shown in FIG. 1, the first and second portions 101 and 109 may be bent outward away from one another in opposite directions proximate the tops of the first notches 104 and 112 and the connecting portions 106 and 114, respectively, at an angle corresponding with the surface of the roof onto which the roof anchor is to be secured.

Figure 6:
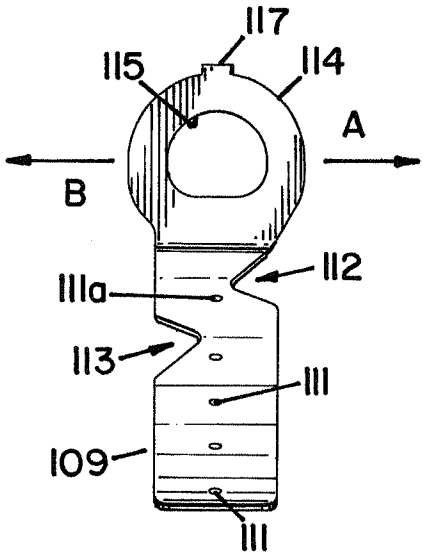
FIG. 6 is a front view of a portion of the roof anchor shown in FIG. 4.
Figure 4:
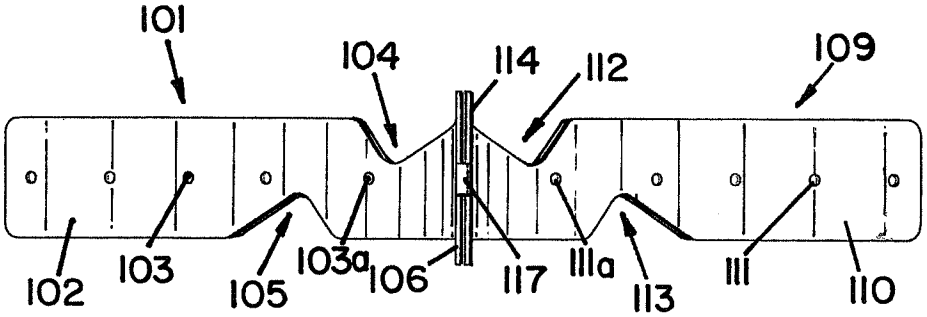
FIG. 4 is a top view of the roof anchor shown in FIG. 1 configured to be operatively connected to a pitched roof.
Figure 5:
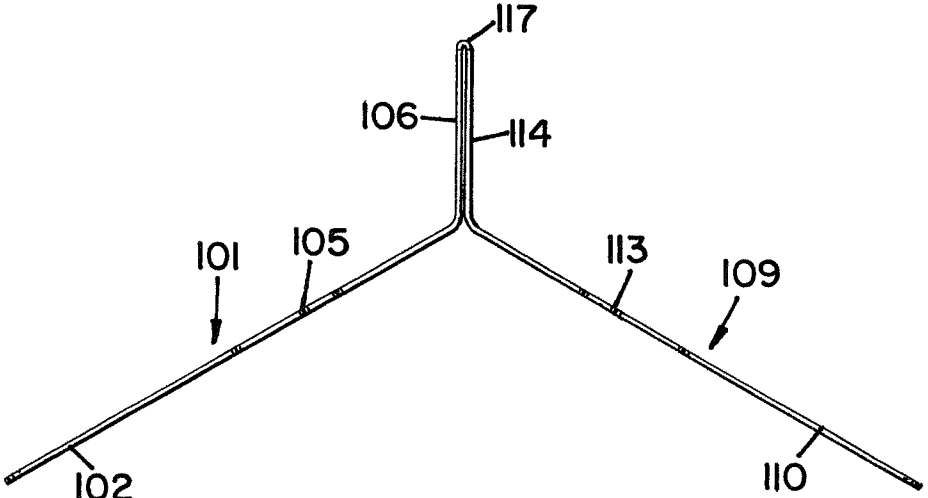
FIG. 5 is a side view of the roof anchor shown in FIG. 4.

If the roof anchor 100 is pre-formed as shown in FIG. 7, which preferably occurs during the manufacture process after it has been stamped and before it is plated, the first and second portions 101 and 109 are already bent so that the securing portions 102 and 110 extend outward away from one another after the interconnecting portion 117 has been folded. Because the roof anchor 100 is preferably pliable, the angles at which the portions 101 and 109 are pre-formed may be changed during installation of the roof anchor 100 to accommodate various roof pitches. The angles of the securing portions 102 and 110 may easily be changed by bending the portions 101 and 109 proximate the pre-formed bends to accommodate various roof pitches such as peaked, sloped, or flat. For connection proximate a peak of a roof, a possible configuration of the roof anchor 100 is shown in FIGS. 4-6, which shows a pre-formed roof anchor 100 after the interconnecting portion 117 has been folded.

The securing portion 102 includes the plurality of apertures 103 and the aperture 103*a* between the first and second notches 104 and 105, and the securing portion 110 includes the plurality of apertures 111 and the aperture 111*a* between the first and second notches 112 and 113. The apertures 103, 103*a*, 111, and 111*a* are preferably pre-drilled holes that facilitate anchorage to the truss of the roof using fasteners. The fasteners extend through the apertures 103, 103*a*, 111, and 111*a* to anchor each securing portion 102 and 110 to the truss. The fasteners used to secure the roof anchor 100 to the truss of the roof may be galvanized, vinyl-coated, or cement-coated nails; type 16d nails; screws; or any suitable fastener known in the art.

The dimensions of the roof anchor 100 are preferably approximately 0.075 inch by 2.00 inches by 23.17 inches, but other dimensions may be used. The total capacity of the roof anchor 100 is preferably 310 pounds, and the roof anchor 100 is preferably capable of withstanding approximately 1,800 pounds of force in any direction of loading. The roof anchor 100 is preferably used as a temporary roof structure and the connecting portions 106 and 114 are bent down against the roof surface and covered with shingles after use. However, if the roof anchor 100 is made out of a non-corrosive material such as stainless steel, it may be used as a permanent roof structure, and the securing portions 102 and 110 may be covered with shingles or flashing to protect the roof from water damage as well as to help conceal the roof anchor 100, leaving only the connecting portions 106 and 114 exposed and readily accessible. The roof anchor 100 provides an anchorage point for fall protection safety systems during construction of the roof. The roof anchor 100 may also provide an anchorage point for fall protection safety systems during subsequent repair of the roof. To connect to the roof anchor 100, snap hooks, carabiners, or other suitable connectors well known in the art may be used.

The roof anchor 100 is configured and arranged to be anchored to at least one truss of a roof. It is recognized that the roof may be a pitched roof with a peak or a flat roof. For a pitched roof, it is also recognized that the pitch of the roof and the angle of the peak may vary. The roof anchor 100 may be anchored to the roof proximate the peak of the roof or proximate a flat surface of the roof. Commonly, the truss of the roof is covered with a sheathing, and the sheathing is covered with overlapping shingles. The peak of the roof is covered with a ridge cap overlapping the shingles proximate the peak of the roof.

Figure 10:
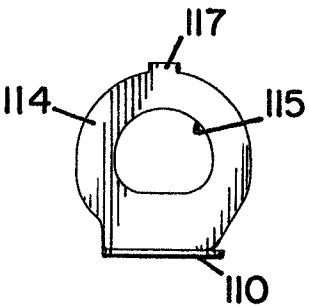
FIG. 10 is a front view of a portion of the roof anchor shown in FIG. 8.
Figure 8:
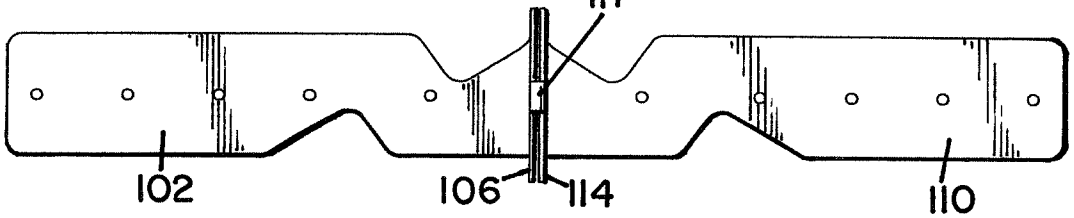
FIG. 8 is a top view of the roof anchor shown in FIG. 1 configured to be operatively connected to a flat surface of a roof.
Figure 9:
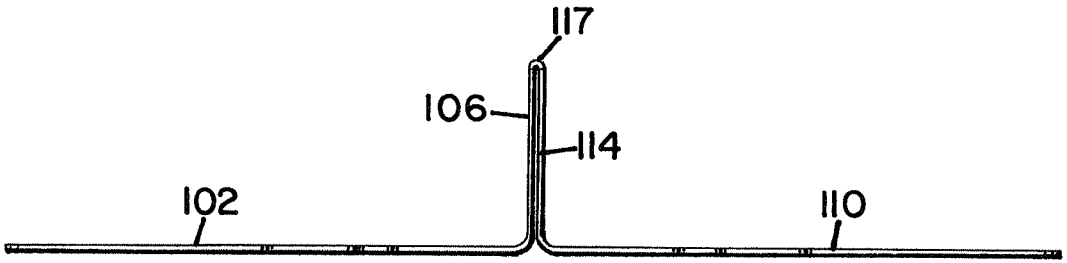
FIG. 9 is a side view of the roof anchor shown in FIG. 8.

There are many ways known in the art for using the roof anchor 100 with fall protection safety systems. Two examples are shown in FIGS. 2 and 3. As shown in FIG. 2, the roof anchor 100 is connected to the roof 120 with the portions 101 and 109 at an angle corresponding to the pitch of the roof 120 and on trusses on opposite sides of the peak of the roof 120. FIGS. 4-6 show a possible configuration of the roof anchor 100 for connection proximate a peak of a roof. A self-retracting lifeline 131 interconnects a full body safety harness 130 donned by a user and the roof anchor 100. For connection to a flat roof, the portions 101 and 109 are simply bent to form an angle of approximately 180 degrees. As shown in FIG. 3, the roof anchor 100 is connected to the roof 120 with portions 101 and 109 at an angle of approximately 180 degrees corresponding to the relatively flat surface of the roof 120. FIGS. 8-10 show a possible configuration of the roof anchor 100 for connection to the relatively flat surface. A lifeline 132 is operatively connected to the roof anchor 100 and a counterweight 136. The counterweight 136 is preferably used to keep the lifeline 132 relatively straight on the surface of the roof 120. A rope grab 133 slides along the lifeline 132, and a lanyard 134 including an energy absorber 135 interconnects a full body safety harness 130 donned by a user and the rope grab 133.

In use, the interconnecting portion 117 is folded so that the apertures 107 and 115 are aligned and the securing portions 102 and 110 are at the desired angle to correspond with the surface upon which they are to be secured. The optional score line 117*a* assists in folding the interconnecting portion 117 in a desired location on the interconnecting portion 117. If the roof anchor 100 is in a flattened condition, the portions 101 and 109 are bent outward away from one another proximate the tops of the notches 104 and 112 and the connecting portions 106 and 114, respectively, so that the securing portions

102 and 110 correspond with the angle of the surface, the roof, upon which the roof anchor 100 will be mounted. If the roof anchor 100 is pre-formed, the portions 111 and 109 may be bent to change the angle between the securing portions 102 and 110 to correspond with the angle of the surface, the roof, upon which the roof anchor 100 will be mounted.

Preferably, the roof anchor 100 should be installed after the sheathing has been installed on the roof and should not be installed directly onto the truss(es). The securing portions 102 and 110 are placed on top of the sheathing with the apertures 103, 103*a*, 111, and 111*a*, respectively, positioned over the truss(es) or other suitable structural member of the roof such as a rafter. The securing portions 102 and 110 are anchored onto the truss, which is preferably made of a wood construction capable of meeting the anchorage strength requirements, with preferably ten fasteners, five fasteners on each securing portion 102 and 110. Preferably, pilot holes ⅛ inch in diameter are drilled into the truss to prevent splitting of the truss when the fasteners are inserted through the plurality of apertures 103 and 111 and driven into the truss. The fasteners must penetrate the truss.

The roof anchor 100 may be temporary and be removed prior to shingling the roof or it may be a permanent fixture of the roof. The roof anchor 100 is configured and arranged such that standard roofing materials such as shingles and a ridge cap can be installed over the roof anchor 100 with only the connecting portions 106 and 114 extending outward from the roofing materials. Shingles may be tucked under the connecting portions 106 and 114. Preferably, the roof anchors 100 should be positioned at least 6 feet from any exposed roof edge and should be spaced approximately 8 feet apart. Preferably, only one fall protection safety system should be connected to the roof anchor 100 at a time, and the user should stay within 30 degrees from the roof anchor 100 to minimize swing falls.

The connecting portions 106 and 114 preferably deform when subjected to a load should a fall occur, which allows the fasteners to be subjected to shearing loads thereby providing greater load-carrying capacity than pulling or prying on the fasteners. Should a fall occur, the roof anchor 100 tends to twist proximate the notches 104, 105, 112, and 113, which prevents the fasteners from being pulled out of the truss as tends to occur with prior art roof anchors.

More specifically, if a load is exerted on the connecting portions 106 and 114 in the direction A shown in FIG. 6, the roof anchor 100 will twist or bend or otherwise deform proximate the second notches 105 and 113 and the fasteners extending through the apertures 103*a* and 111*a* may be at least partially pulled out of the roof. If a load is exerted on the connecting portions 106 and 114 in the direction B shown in FIG. 6, the roof anchor 100 will twist or bend or otherwise deform proximate the first notches 104 and 112 and the fasteners extending through the apertures 103*a* and 111*a* will likely remain secured. Thus, when loads are exerted to the sides of the roof anchor, the notches allow the connecting portions 106 and 114 to twist or bend or otherwise deform thereby allowing the connector operatively connected to the connecting portions 106 and 114 to be proximate the roof, which reduces the likelihood that at least the plurality of fasteners 103 and 111 will be pulled out of the roof should a fall occur.

The connector, which is operatively connected to the connecting portions 106 and 114, is preferably centered on the length of the anchor 100 with fasteners through the securing portions 102 and 110 on both sides of the connector, which provides greater load-carrying capacity than if a connector were located at each end of the anchor. This allows the load to be balanced between the fasteners securing the securing portions 102 and 110 of the anchor 100 to the roof, which provides greater load-carrying capacity than a fixed connector.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A roof anchor, comprising:

a pliable member including an interconnecting portion interconnecting a first portion and a second portion;

the first portion including a first securing portion with a first plurality of apertures and a first connecting portion with a first aperture, a first notch and a second notch are proximate a first juncture of the first securing portion and the first connecting portion, the first notch and the second notch extending inward from opposing sides of the first portion toward proximate a middle of the first portion, a second aperture being between the first notch and the second notch; and the second portion including a second securing portion with a second plurality of apertures and a second connecting portion with a third aperture, a third notch and a fourth notch are proximate a second juncture of the second securing portion and the second connecting portion, the third notch and the fourth notch extending inward from opposing sides of the second portion toward proximate a middle of the second portion, a fourth aperture being between the third notch and the fourth notch.

2. The roof anchor of claim 1, wherein the pliable member is an integral piece of pliable material.

3. The roof anchor of claim 1, wherein the first portion and the second portion are mirror images.

4. The roof anchor of claim 1, wherein the first plurality of apertures are longitudinally spaced along the first securing portion and the second plurality of apertures are longitudinally spaced along the second securing portion.

5. The roof anchor of claim 1, wherein the first and second notches are staggered along the first portion and the third and fourth notches are staggered along the second portion.

6. The roof anchor of claim 1, wherein the interconnecting portion is bent to align the first aperture and the second aperture and the first and second portions are bent proximate the first and third notches to form an angle between the first and second securing portions corresponding with a mounting surface.

7. The roof anchor of claim 1, wherein the interconnecting portion includes a score line.

8. A roof anchor comprising:

a first portion including, an elongated relatively rectangular first securing portion, the first securing portion having first and second notches extending inward from opposing sides of the first securing portion, and a first connection portion that extends from the first securing portion proximate the first and second notches of the first securing portion, the first and second notches configured and arranged to allow the first portion to deform as the result of a load exerted on the first connection portion, the first securing portion including a plurality of first apertures; and a second portion including, an elongated relatively rectangular second securing portion, the second securing portion having third and fourth notches extending inward from opposing sides of the second securing portion, and a second connection portion that extends from the second securing portion proximate the third and fourth notches of the second securing portion, the second connection portion of the second portion coupled to the first connection portion of the first portion, the third and fourth notches configured and arranged to allow the second portion to deform as the result of a load exerted on the second connection portion, the second securing portions including a plurality of second apertures.

9. The roof anchor of claim 8, further wherein at least one of the first, second, third and fourth notches are generally V-shaped.

10. The roof anchor assembly of claim 8, wherein the first and second notches are staggered along the first portion and the third and fourth notches are staggered along the second portion.

11. The roof anchor of claim 8, further comprising:

an interconnection portion coupling the first connection portion to the second connection portion, the interconnection portion including a score line configured and arranged to allow for the bending of the first portion in relation to the second portion.

12. The roof anchor assembly of claim 8, wherein the first connection portion includes a first connection aperture and the second connection portion includes a second connection aperture, further wherein the first connection aperture and the second connection aperture are configured and arranged to be aligned to receive a suitable connector.

13. A roof anchor comprising:

a first portion including, an elongated relatively rectangular first securing portion, the first securing portion having generally V-shaped first and second notches extending inward from opposing sides of the first securing portion staggered in generally a staggered configuration, and a first connection portion that extends from the first securing portion proximate the first and second notches of the first securing portion, the first and second notches configured and arranged to allow the first portion to deform as the result of a load exerted on the first connection portion, the first securing portion including a plurality of first apertures; and a second portion including, an elongated relatively rectangular second securing portion, the second securing portion having generally V-shaped third and fourth notches extending inward from opposing sides of the second securing portion in generally a staggered configuration, and a second connection portion that extends from the second securing portion proximate the third and fourth notches of the second securing portion, the second connection portion of the second portion coupled to the first connection portion of the first portion, the third and fourth notches configured and arranged to allow the second portion to deform as the result of a load exerted on the second connection portion, the second securing portions including a plurality of second apertures.

14. The roof anchor of claim 13, further comprising:

an interconnection portion coupling the first connection portion to the second connection portion, the interconnection portion including score line configured and arranged to allow for the bending of the first portion in relation to the second portion.

15. The roof anchor assembly of claim 13, wherein the first connection portion includes a first connection aperture and the second connection portion includes a second connection aperture, further wherein the first connection aperture and the second connection aperture are configured and arranged to be aligned to receive a suitable connector when the first connector portion is folded onto the second connection portion.

* * * * *